US009975025B2

(12) United States Patent
McCrane

(10) Patent No.: US 9,975,025 B2
(45) Date of Patent: May 22, 2018

(54) SUPPORT BELT

(71) Applicant: Implus Footcare, LLC, Durham, NC (US)

(72) Inventor: David Patrick McCrane, Napa, CA (US)

(73) Assignee: Implus Footcare, LLC, Durham, NC (US)

( * ) Notice: Subject to any disclaimer, the term of this patent is extended or adjusted under 35 U.S.C. 154(b) by 173 days.

(21) Appl. No.: 14/500,525

(22) Filed: Sep. 29, 2014

(65) Prior Publication Data

US 2016/0089565 A1 Mar. 31, 2016

(51) Int. Cl.

| | |
|---|---|
| ***A63B 21/06*** | (2006.01) |
| ***A63B 69/00*** | (2006.01) |
| ***A63B 23/02*** | (2006.01) |
| ***A63B 21/00*** | (2006.01) |

(52) U.S. Cl.

CPC ..... *A63B 69/0059* (2013.01); *A63B 21/4009* (2015.10); *A63B 21/4025* (2015.10); *A63B 23/0205* (2013.01); *A63B 23/0238* (2013.01)

(58) Field of Classification Search

CPC . A41F 9/002; A41F 9/02; A63B 23/00; A63B 23/02; A63B 23/0205; A63B 23/0211; A63B 23/0216; A63B 23/0222; A63B 23/0227; A63B 23/0233; A63B 23/0238; A63B 23/0244; A63B 23/025; A63B 23/03757; A63B 21/00; A63B 21/40; A63B 21/4001; A63B 21/4009

USPC ..... 482/92, 93, 121–129, 148; 182/3; 2/336–338, 908–920

See application file for complete search history.

(56) References Cited

U.S. PATENT DOCUMENTS 4,572,167 A * 2/1986 Brunswick ..... A61F 5/028 2/44
4,829,989 A * 5/1989 Deamer ..... A61F 5/02 602/19
4,833,730 A * 5/1989 Nelson ..... A61F 5/028 2/44
4,964,401 A * 10/1990 Taigen ..... A61F 5/028 128/876
4,968,027 A * 11/1990 Anderson ..... A61F 5/028 2/322
4,984,786 A * 1/1991 Lemke ..... A63B 21/4001 482/105
5,036,864 A * 8/1991 Yewer, Jr. ..... A41F 9/002 128/876
5,046,488 A * 9/1991 Schiek, Sr. ..... A61F 5/028 2/338
5,158,510 A * 10/1992 Lemire ..... A63B 21/4001 482/51

(Continued)

*Primary Examiner* — Stephen R Crow
*Assistant Examiner* — Garrett Atkinson
(74) *Attorney, Agent, or Firm* — Edward S. Wright

(57) ABSTRACT

A support belt for stabilizing lower back and abdominal muscles during heavy lifting, comprising: an elongated body that wraps about the waist of a person, with overlapping abdominal support sections toward the ends of the body and a lumbar support section midway between the ends, stiffener panels on the lumbar and abdominal support sections, a strap on the outer side of the body for securing the body about the waist, and means for limiting vertical movement and pivotal movement and/or skewing between the overlapping sections without impairing lengthwise movement between them.

19 Claims, 5 Drawing Sheets

(56) References Cited

U.S. PATENT DOCUMENTS

| | | | | | |
|---|---|---|---|---|---|
| 5,279,386 | A * | 1/1994 | Cearley | A62B 35/0031 | 119/907 |
| 5,316,022 | A * | 5/1994 | Schiek, Sr. | A61F 5/028 | 128/876 |
| 5,528,771 | A * | 6/1996 | Yudin | A61F 5/028 | 128/112.1 |
| D422,709 | S * | 4/2000 | Caswell | D2/624 | |
| 6,053,883 | A * | 4/2000 | Schiek, Sr. | A61F 5/028 | 602/19 |
| 6,551,221 | B1 * | 4/2003 | Marco | A63B 21/0004 | 280/600 |
| 7,077,794 | B1 * | 7/2006 | Bray | A41D 13/0525 | 482/111 |
| 7,931,571 | B2 * | 4/2011 | Bernardoni | A61F 5/0102 | 434/255 |

* cited by examiner

SUPPORT BELT

BACKGROUND OF THE INVENTION

Field of Invention

This invention pertains generally to weightlifting and other activities involving the lifting of heavy objects and, more particularly, to a support belt for stabilizing lower back and abdominal muscles during heavy lifting.

Related Art

Support belts are used widely to protect the lower back while engaging in weightlifting and other activities that involve the lifting and/or moving of heavy objects. Some belts also provide support for the abdomen in addition to supporting the back. Examples of such belts are found in U.S. Pat. Nos. 5,046,488, 5,316,022, and 6,053,883.

OBJECTS AND SUMMARY OF THE INVENTION

It is, in general, an object of the invention to provide a new and improved support belt for stabilizing lower back and abdominal muscles during heavy lifting.

Another object of the invention is to provide a support belt of the above character which overcomes the limitations and disadvantages of support belts heretofore provided.

These and other objects are achieved in accordance with the invention by providing a support belt having an elongated body that wraps about the waist of a person, with overlapping abdominal support sections toward the ends of the body and a lumbar support section midway between the ends, a strap on the outer side of the body for securing the body about the waist, and means for limiting vertical movement and/or skewing between the overlapping sections without impairing lengthwise movement between them. The disclosed embodiment also has stiffener panels on the abdominal and lumbar support sections.

DETAILED DESCRIPTION

Figure 1:
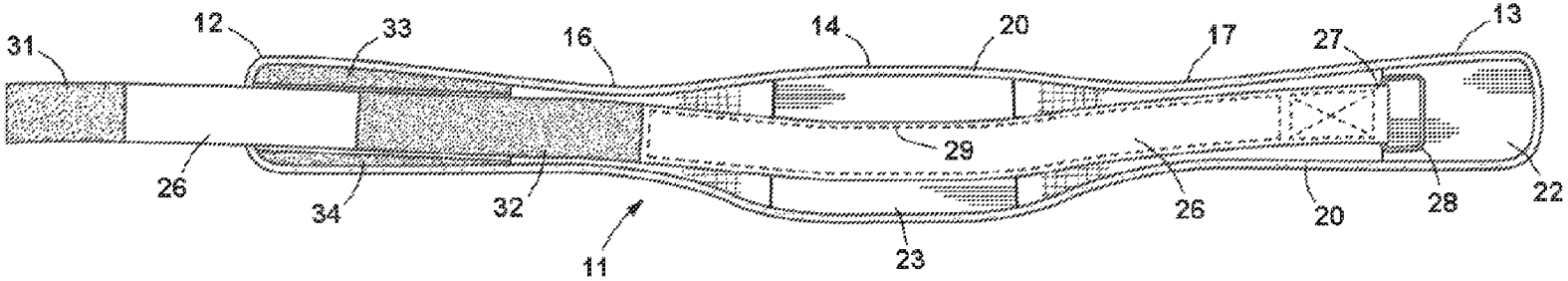
FIG. 1 is an elevational view of the outer side of one embodiment of a support belt incorporating the invention.
Figure 2:
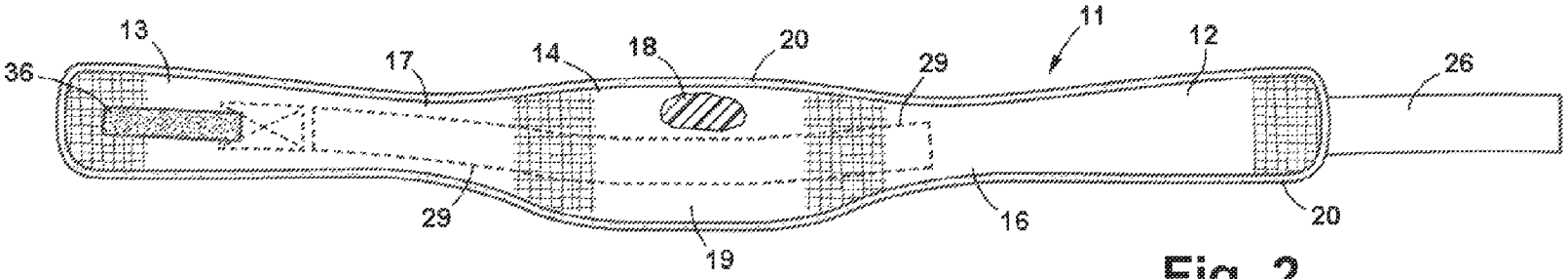
FIG. 2 is an elevational view of the inner side of the embodiment of FIG. 1.
Figure 3:
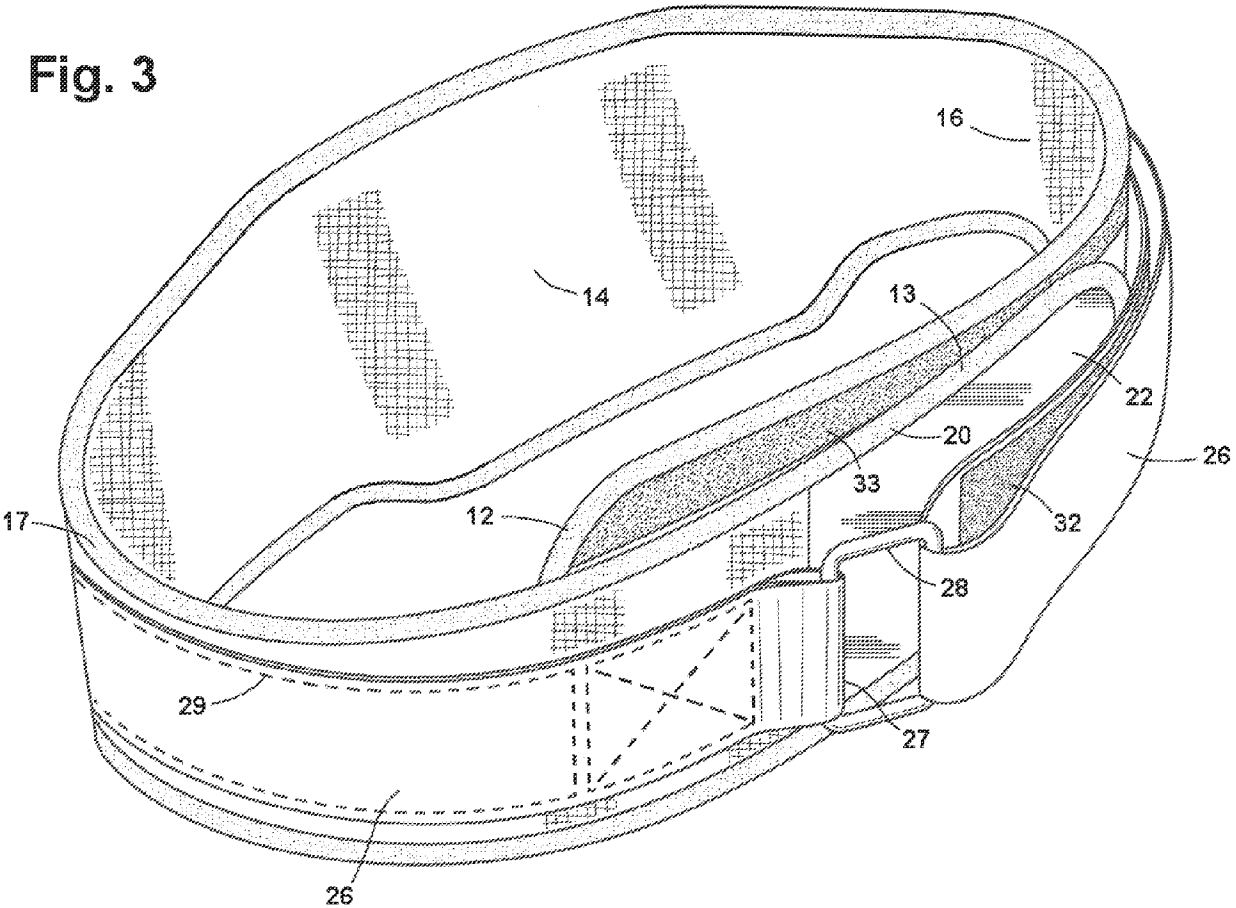
FIG. 3 is an isometric view of the embodiment of FIG. 1 configured for encircling the waist of a person.

As illustrated in the drawings, the belt includes an elongated body 11 that wraps about the waist of a person, with overlapping abdominal support sections 12, 13 toward the ends of the body, a lumbar support section 14 midway between the ends, and side sections 16, 17 between the support sections. In the embodiment illustrated, the body consists of a flexible, lightweight foam core 18 enclosed within an abrasion resistant cover 19, which supports the abdomen and back. The body can, however, be fabricated of any suitable material such as leather, rubber, nylon, or webbing that will provide the desired support. Binding tape

20 extends about the periphery of the body and is attached to the cover by stitching or other suitable means (not shown).

The abdominal and lumbar support sections are of greater height than the sections between them. Thus, for example, the abdominal support sections can have a height of approximately 4 inches, the lumbar support section can have a height of approximately 5 inches, and the side sections can have a height of approximately 3 inches. In another exemplary embodiment, the abdominal and lumbar sections have heights of approximately 4 and 6 inches, respectively, and the sides have a height of approximately 3 inches. The reduced height of the side sections allows a person wearing the belt to flex more comfortably from side to side without sacrificing the support provided by the abdominal and lumbar sections.

Stiffening panels 21-23 are attached to the outer sides of the abdominal and lumbar support sections of the body. These panels are fabricated of flexible plastic sheet material and provide additional support in the abdominal and lumbar regions. They are attached to the body by suitable means such as stitching (not shown). In one presently preferred embodiment, the panels extend to the upper and lower edges of the support sections and are secured to the body by the same stitching that attaches the binding tape to the cover.

A strap 26 for securing the body about the waist of a user extends along the outer side of the body, with one end of the strap extending freely from the abdominal support 12 at one end of the body. The other end of the strap is folded back and secured to the body near the inner end of abdominal support 13 to form an anchor 27 for a rectangular metal ring or loop 28. The strap is attached to the body by stitching 29 which extends across lumbar support 14 and terminates near the rear of side section 16.

The free end of the strap passes through the ring and is folded back upon itself and secured with a fastener which, in the embodiment illustrated, is a Velcro® hook and loop fastener consisting of hook material 31 near the outer end of the strap and loop material 32 spaced from the hook material on the outer side of the strap. Strips of the hook and loop materials are affixed to the strap by suitable means such as stitching (not shown).

With no fasteners between the overlapping sections 12, 13 at the ends of the body, those sections are free to move both horizontally and vertically as well as to pivot or skew with respect to each other, giving the wearer a degree of freedom and comfort not found with other belts.

Means is provided for limiting vertical movement and/or skewing between the overlapping sections to keep them from moving too far. This means includes strips of Velcro® material 33, 34 which extend along the upper and lower margins on the outer side of end section 12 and a centrally disposed strip of Velcro® material 36 on the inner side of end section 13. Velcro® strips 33, 34 are preferably sewn onto stiffener panel 21 before the panel is sewn onto the body, rather than attaching the Velcro® strips by sewing through all three layers. Strips 33, 34 are one type of Velcro® material, and strip 36 is the other. Thus, in the embodiment illustrated, strips 33, 34 have the loops, and strip 36 has the hooks.

Strips 33, 34 are spaced apart or separated vertically and serve as limiting abutments or barriers for the central strip or tongue 36, with downward movement of end section 12 and upward movement of end section 13 being limited by engagement between the upper edge 36*a* of tongue 36 and the lower edge 33*a* of upper barrier strip 33. Upward movement of end section 12 and downward movement of end section 13 are similarly limited by engagement between the lower edge 36*b* of tongue 36 and the upper edge 34*a* of lower barrier strip 34.

Pivotal movement or skewing of the end sections is limited by engagement between the corners of the tongue and the surfaces of the barriers. Thus, for example, clockwise movement of end section 12 relative to end section 13 is limited by engagement of the upper left and lower right corners 36*c*, 36*f* of tongue 36 with the lower edge 33*a* of barrier strip 33 and the upper edge 34*a* of barrier strip 34. Similarly, counterclockwise movement of end section 12 relative to end section 13 is limited by engagement of the upper right and lower left corners 36*d*, 36*e* of tongue 36 with the lower edge 33*a* of barrier strip 33 and the upper edge 34*a* of barrier strip 34.

The degree of movement permitted is determined by the length and width of the tongue and the spacing between the barriers, with a narrower tongue and/or greater spacing permitting greater vertical movement. In order to limit pivotal movement or skewing, the diagonal length of the tongue, i.e. the distance between corners 36*c* and 36*f* and between corners 36*d* and 36*e*, must be greater than the separation or spacing between the barriers. As long as that condition is met, the degree of pivotal movement or skewing permitted decreases with increases in the length and/or width of the tongue and decreases in the distance between the barriers.

As long as the tongue remains free of engagement with the barriers, the end sections of the body will be free to move horizontally or lengthwise of each other within the confines of strap 26.

In use, the belt is placed about the waist of a user with lumbar section 14 to the rear, end section 12 against the abdomen, end section 13 overlying end section 12, and Velcro® tongue 36 centered between Velcro® strips 33, 34. The free end of strap 26 is passed through ring 28, folded back upon itself, pulled to tension the belt, then secured by hook and loop fasteners 31, 32.

Figure 4:
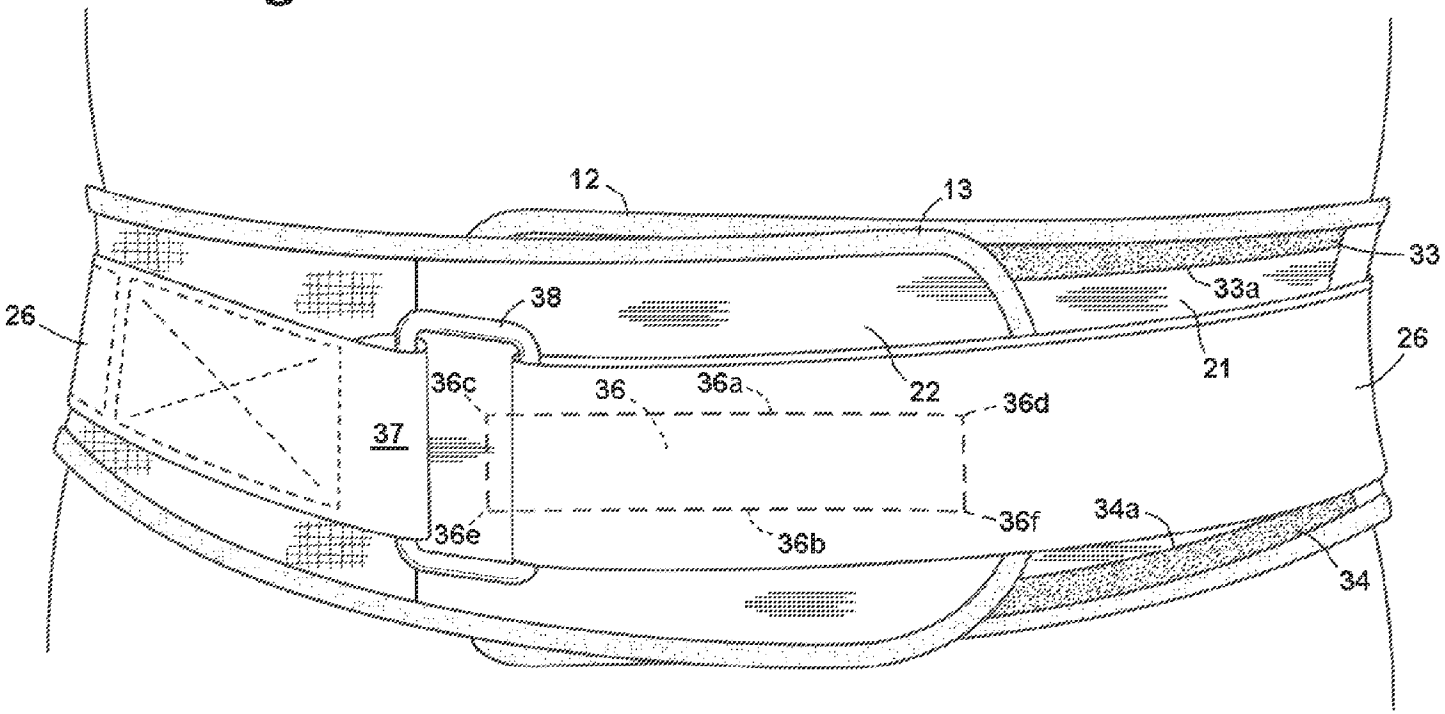
FIG. 4 is a front elevational view of the embodiment of FIG. 1 fastened about the waist of a person.

FIG. 4 shows the belt wrapped about the waist of a user with overlapping end sections 12, 13 aligned in front of the abdomen and tongue 36 centered between barrier strips 33, 34. In this position, the end sections are free to move both horizontally and vertically as well as to rotate or skew with respect to each other.

Figure 5A:
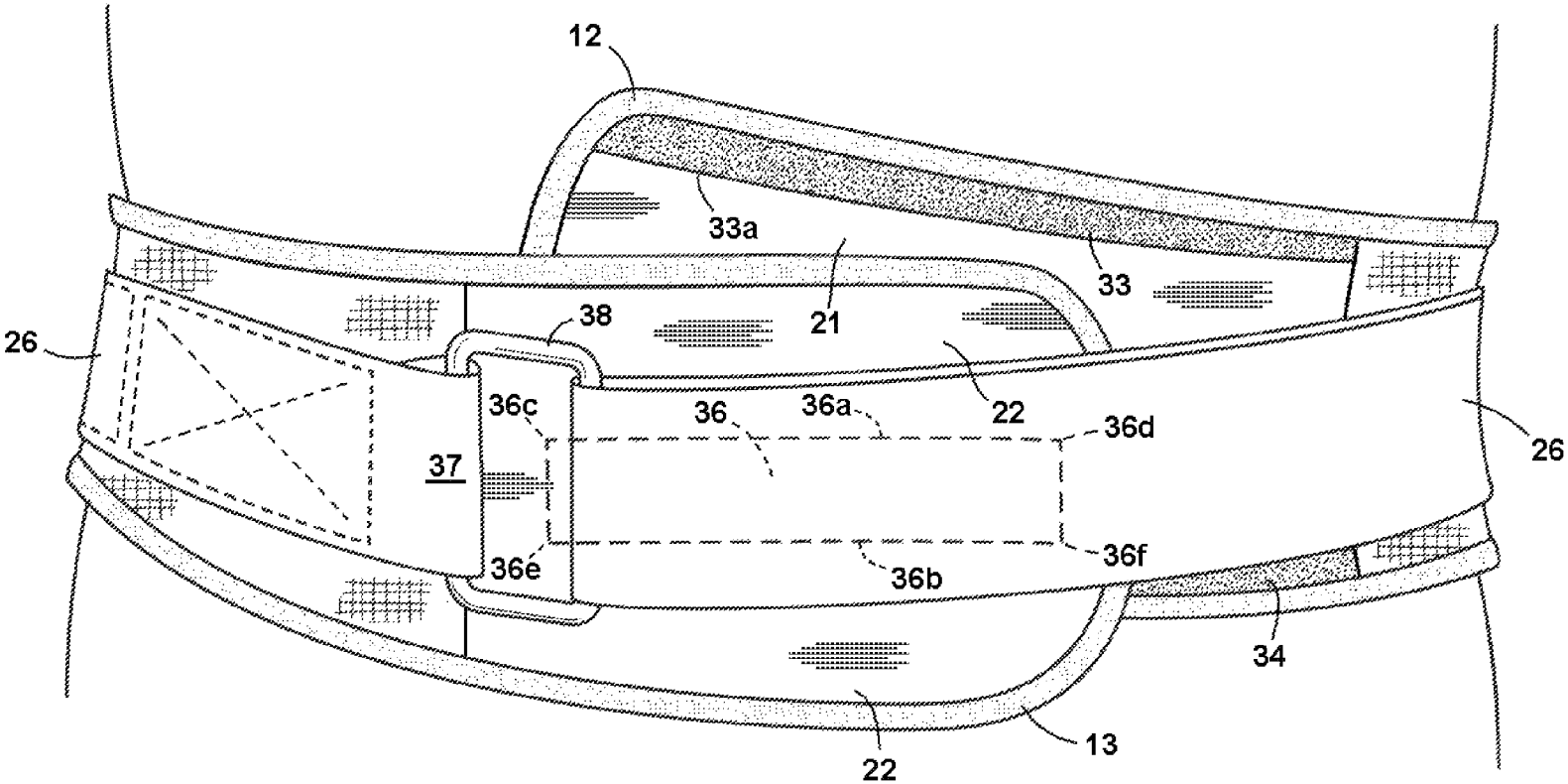
FIGS. 5A and 5B are operational views similar to FIG. 4, showing overlapping end sections of the belt in different positions.

In FIG. 5A, the belt is shown with end section 12 shifted upwardly and the lower edge 36*b* of tongue 36 engaging the upper edge of barrier strip 34 to limit further travel of end section 12 in the upward direction.

Figure 5B:
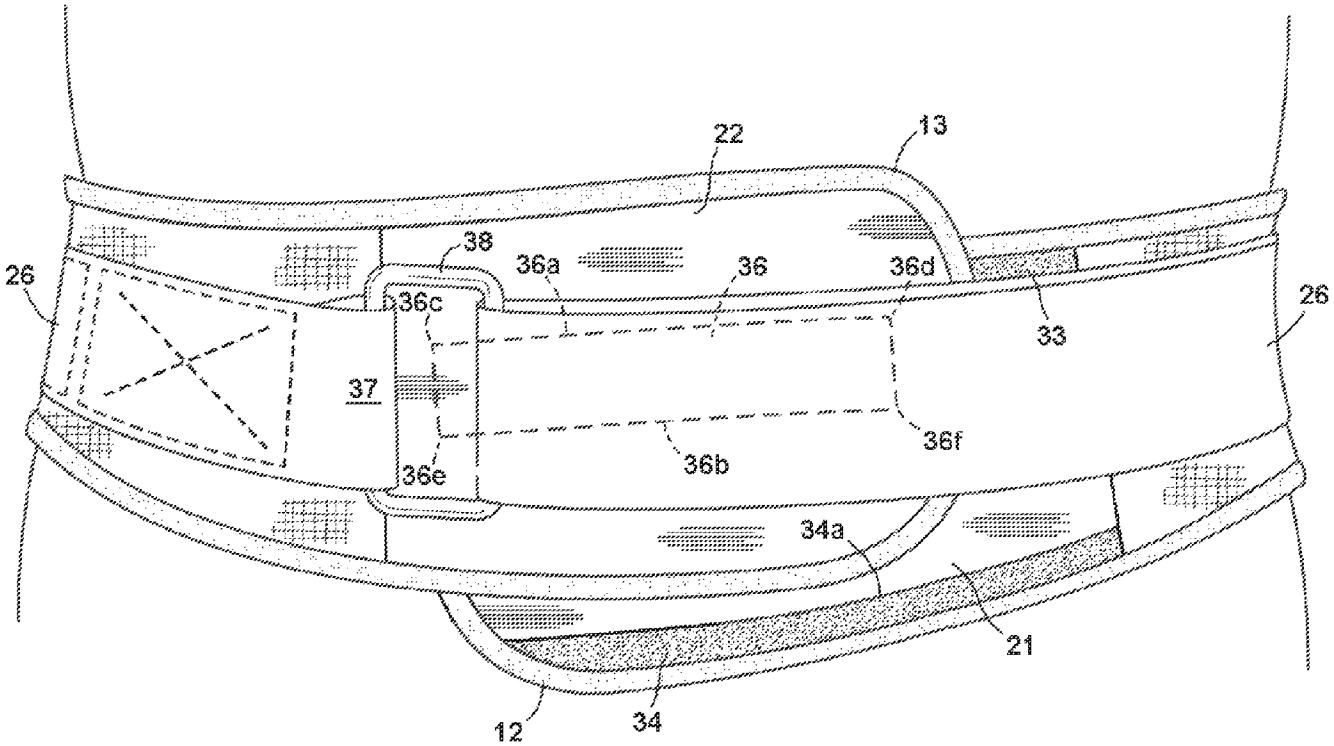

In FIG. 5B, the belt is shown with end section 12 shifted downwardly and the upper edge 36*a* of tongue 36 engaging the lower edge of barrier strip 33 to limit further travel of end section 12 in the downward direction.

The invention has a number of important features and advantages. With the belt tightened about the waist, overlapping abdominal supports 12, 13 stabilize and support the abdominal muscles, and lumbar support 14 stabilizes and supports the muscles in the lower back, with side sections 16, 17 permitting more comfortable side to side flexing. Stiffener panels 21-23 enhance the support both in the abdominal region and in the lumbar region, and Velcro® strips 33-36 on the facing surfaces of the overlapping end sections allow a controlled amount of vertical movement and pivoting or skewing between the abdominal support sections.

The belt is particularly suitable for use in high intensity interval training where the different degrees of support are required for different exercises. With the overlapping end sections of the belt being free to move lengthwise of each other as the strap is loosened or tightened, the amount of support provided by the belt is quickly and easily adjusted as the exerciser moves between different exercises in successive intervals.

It is apparent from the foregoing that a new and improved support belt for stabilizing lower back and abdominal muscles during heavy lifting has been provided. While only certain presently preferred embodiments have been described in detail, as will be apparent to those familiar with the art, certain changes and modifications can be made without departing from the scope of the invention as defined by the following claims.

The invention claimed is:

1. A support belt for stabilizing lower back and abdominal muscles during heavy lifting, comprising: an elongated body that wraps about the waist of a person, with overlapping abdominal support sections toward the ends of the body and a lumbar support section midway between the ends, a strap on the outer side of the body for securing the belt about the waist, and means for limiting vertical movement and/or skewing between the overlapping sections without impairing lengthwise movement between them.

2. The support belt of claim 1 wherein the means for limiting vertical movement and/or skewing comprises a pair of vertically separated barriers extending lengthwise of and affixed to one of the overlapping sections and a tongue of lesser width and greater length than the separation between the barriers affixed to the other overlapping section for movement between the barriers.

3. The support belt of claim 2 wherein the barriers comprise strips of hook and loop fastener material, and the tongue comprises a patch of hook and loop material that is complementary to the barrier strip material.

4. The support belt of claim 1 including stiffener panels on the outer sides of the lumbar and abdominal support sections of the body.

5. The support belt of claim 1 wherein one end of the strap extends beyond one end of the body, passes through a loop attached to the other end of the strap, and is folded back upon itself and secured with a fastener.

6. The support belt of claim 5 wherein the fastener that secures the strap is a hook and loop fastener.

7. A support belt for stabilizing lower back and abdominal muscles during heavy lifting, comprising: an elongated body that wraps about the waist of a person, with overlapping abdominal support sections toward the ends of the body and a lumbar support section midway between the ends, stiffener panels on the outer sides of the lumbar and abdominal support sections of the body, a strap on the outer side of the body for securing the body about the waist, vertically separated barrier strips extending lengthwise along upper and lower edge portions on one side of one of the overlapping sections, and a tongue of greater length and lesser width than the separation between the barrier strips affixed lengthwise to the other overlapping section between the barrier strips.

8. The support belt of claim 7 wherein the barrier strips extend along the outer side of one of the overlapping sections, and the tongue extends along the inner side of the other one of the overlapping sections.

9. The support belt of claim 7 wherein the barrier strips and the tongue are strips of hook and loop fastener material.

10. The support belt of claim 7 wherein one end of the strap extends beyond one end of the body, passes through a loop attached to the other end of the strap, and is folded back upon itself and secured with a fastener.

11. The support belt of claim 10 wherein the fastener that secures the strap is a hook and loop fastener.

12. A support belt for stabilizing lower back and abdominal muscles during heavy lifting, comprising: an elongated body that wraps about the waist of a person, with overlapping abdominal support sections toward the ends of the body and a lumbar support section midway between the ends, a strap on the outer side of the body for securing the body about the waist, vertically separated strips of hook and loop fastener material extending lengthwise along upper and lower edge portions on one side of one of the overlapping sections, and a centrally disposed strip of hook and loop fastener material of greater length and lesser width than the separation between the barrier strips affixed lengthwise to the other overlapping section and cooperating with the vertically separated strips to limit vertical movement and/or skewing between the overlapping sections.

13. The support belt of claim 12 wherein the vertically separated strips of hook and loop fastener material extend along the upper and lower edge portions on the outer side of one of the overlapping sections, and the centrally disposed strip of hook and loop fastener material is on the inner side of the other overlapping section.

14. The support belt of claim 12 wherein the fastener material in the vertically separated strips has loops, and centrally disposed fastener material has hooks.

15. The support belt of claim 12 including stiffener panels on the outer sides of the lumbar and abdominal support sections of the body.

16. The support belt of claim 12 wherein one end of the strap extends beyond one end of the body, passes through a loop attached to the other end of the strap, and is folded back upon itself and secured with a fastener.

17. The support belt of claim 16 wherein the fastener that secures the strap is a hook and loop fastener.

18. A support belt for stabilizing lower back and abdominal muscles during heavy lifting, comprising: an elongated body that wraps about the waist of a person, with overlapping abdominal support sections toward the ends of the body and a lumbar support section midway between the ends, stiffener panels in the lumbar and abdominal support sections of the body, and means for limiting vertical movement and/or skewing between the overlapping abdominal support sections without impairing lengthwise movement between them.

19. The support belt of claim 18 wherein the stiffener panels are attached to the body on the outer sides of the lumbar and abdominal support sections.

* * * * *